US005165881A

United States Patent [19]

Wicén

[11] Patent Number: 5,165,881

[45] Date of Patent: Nov. 24, 1992

[54] ROTOR FOR A SCREW ROTOR MACHINE

[75] Inventor: Jan Wicén, Värmdö, Sweden

[73] Assignee: Opcon Autorotor AB, Nacka, Sweden

[21] Appl. No.: 760,690

[22] Filed: Sep. 16, 1991

[51] Int. Cl.[5] ..... F01C 1/16; F01C 21/08; F16B 17/00

[52] U.S. Cl. ..... 418/152; 418/201.1; 416/223 R; 403/267; 403/359; 403/383; 264/274

[58] Field of Search ..... 418/152, 201.1, 201.3; 403/267, 359, 383; 264/271.1, 274; 416/223 R, 224

[56] References Cited

U.S. PATENT DOCUMENTS 4,490,102 12/1984 Carrë et al. ..... 418/201.1
4,761,124 8/1988 Timuska et al. ..... 418/201.3
4,846,642 7/1989 Nuber et al. ..... 418/201.1

FOREIGN PATENT DOCUMENTS 188513 10/1904 Fed. Rep. of Germany ..... 264/274
463829 1/1991 Sweden .

*Primary Examiner*—John J. Vrablik
*Attorney, Agent, or Firm*—Frishauf, Holtz, Goodman & Woodward

[57] ABSTRACT

A rotor for a screw rotor machine, which rotor comprises a metal shaft (3, 13) and a rotor body (1) of plastics material moulded on the shaft, which is provided with a number of radially extending projections (4) with equal distribution around the shaft, which projections (4) are provided with essentially peripherally extending wings (5) originating from the ridge of the projections (4).

12 Claims, 1 Drawing Sheet

ROTOR FOR A SCREW ROTOR MACHINE

BACKGROUND OF THE INVENTION

The present invention relates to a rotor for a screw rotor machine

On rotors of this type, with a rotor body of plastics material moulded on a shaft, the shaft is prevented from being twisted off from the rotor body by the shaft being provided with radially protruding projections distributed in equal partition around the shaft. For especially female rotors it is thereby suitable to design the projections as helical, radial flanges with the same pitch as the lands of the rotor body, in which the flanges extend a short distance into the central part of the lands. At high rpm it has turned out that the rotor bodies in spite of these measures are inclined to be broken off or separate from the shaft and its projections.

The object of the invention is to bring about an additional reinforcement of the rotor body's adhesion to the shaft and its projections.

SUMMARY OF THE INVENTION

According to the present invention, a rotor for a screw rotor machine has a number of helically extending lands (10) and intermediate grooves forming a working face of the rotor. The rotor further comprises a shaft member (13); a rotor body (1) made of plastics material molded on the shaft member (13) so as to adhere to the surface of the shaft member (13), said rotor body made of plastics material defining said lands such that said lands are substantially made of plastics material; and a plurality of radially directed projections (4) extending from the shaft member (13) with substantially equal distribution around the shaft member (13). The lands 10 are defined by the plastic motor body and are formed substantially of plastics material. The projections (4) are integrally formed as one piece with the shaft member (13) and extend helically around the surface of the shaft member (13) with the same pitch as the lands (10), the projections (4) each being associated with and in registration with a respective corresponding land (10). The projections extend into a central part of the corresponding land (10). The projections (4) further have substantially peripherally directed wings (5) with smoothly rounded edges, the wings (5) being integrally formed as one piece with the projections (4), the wings (5) being located substantially in the central part of the corresponding land (10) and being dimensioned to relieve during rotation of the rotor a large part of tensile stresses acting on the plastics material of the rotor body (1) adhering to the surface of the shaft member (13).

By means of the peripherally directed wings of the projections a large part of the tensile force is relieved, which otherwise at the rotation of the rotor would arise at the surface of the rotor shaft due to the mass of the part of the rotor body positioned radially outside the shaft. The wings shall suitably be placed as distant as possible from the surface of the shaft. If the shrinking of the projections can be arranged to exceed the shrinking of the plastics material during the rotor's cooling at the manufacturing, even compression of the plastics material radially inside the wings might be achieved.

The projections and wings belonging to them can be designed in several ways in order to support the adhesion of the rotor body to the shaft. Especially simple and efficient even from a manufacturing point of view is to let each projection be equipped with two in opposite directions extending, similar wings, originating from the projection's ridge. In this case these should be extending without disruption between the rotor's ends, and one can easily and cheaply produce the shaft with projections and wings in an extruding operation. This is suitably done by using a suitable light metal. If the shaft's rigidity has to be reinforced a tubular shaft can be extruded which then is pressed onto a steel shaft. At the extruding operation the projections and the wings can be given a helical design with the same pitch as the intended lands of the rotor body. A male rotor should in that case have as many lands as projections, at which each projection should extend a bit into the central part of the corresponding land, where the wings have the largest tensile force reducing effect.

BRIEF DESCRIPTION OF THE DRAWINGS

The invention will now be described in more detail in the following with reference to the accompanying drawings, which show different examples of embodiments of rotors according to the invention, FIGS. 1 and 2, respectively, are perspective views of respectively a female and a male rotor.

DETAILED DESCRIPTION

Figure 1:
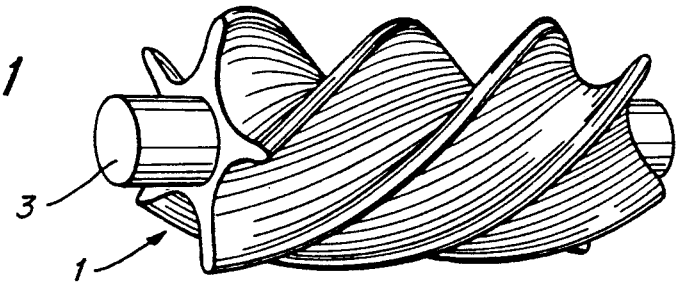
Figure 3:
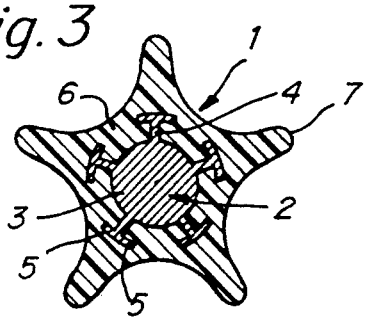
FIGS. 3 and 4 are cross sectional views of the rotors shown in FIGS. 1 and 2.

FIGS. 1 and 3 show a female rotor with a rotor body 1 moulded of a plastics material on a metal core 2 in a manner known per se. The metal core comprises a circular shaft 3 provided with a number of radial projections or flanges 4, extending along almost the whole length of the rotor body. Along the outer edge line of each flange 4 are extending two in opposite directions directed, peripheral wings 5.

The rotor body 1 has a circular cylindrical part 6, coaxial with the shaft 3 from which part the helically designed lands 7 extend.

The metal core 2 is extruded with helically designed continuous flanges 4 and wings 5, at which by symmetrical reasons a flange 4 is arranged in the line with each land 7. The flanges 4 with wings 5 can also have another location with respect to the lands 7 and another number, and they can also be straight.

Figure 2:
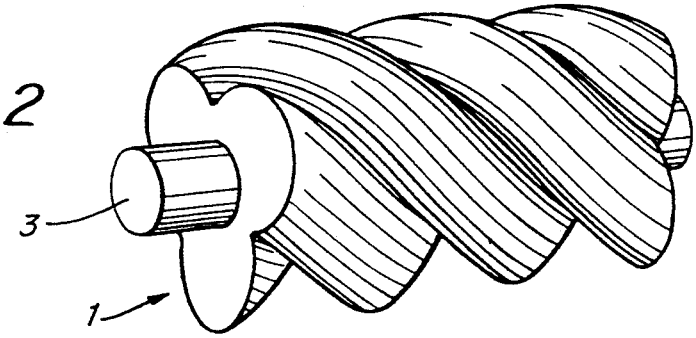
Figure 4:
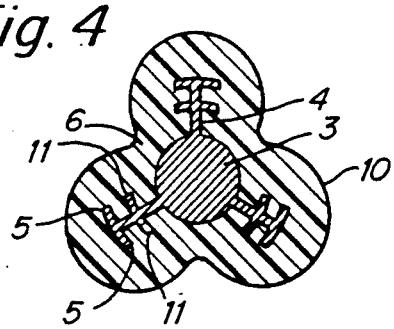

The male rotor shown in FIGS. 2 and 4, however, must have the same number of flanges 4 as the number of lands 10 and be helically designed together with the wings 5 in the central parts of the lands 10. Possibly every flange 4 may be equipped with an additional pair of wings 11. The mass of the lands 10 is considerably larger than the mass of the female rotor's lands 7, which makes the invention first of all intended for male rotors.

Figure 5:
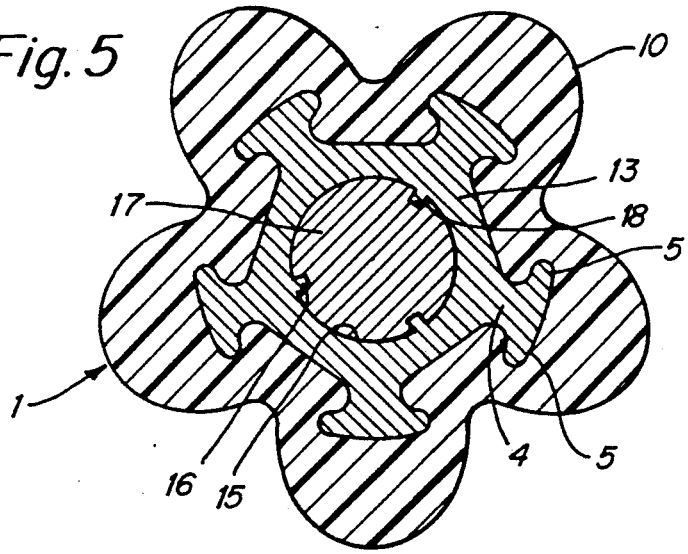
FIG. 5 is a cross sectional view of a male rotor according to a preferred embodiment.

The preferred embodiment shown in FIG. 5 is a male rotor with five lands 10. It has a shaft 13 with a mainly pentagonical cross section. The flanges of the shaft 13, are strongly dimensioned and have strongly dimensioned wings 5 with smooth transition sections between wings 5 and flanges 4 as well between flanges 4 and shaft 13.

The dimensioning of the wings 5 is chosen such that the same tensile stress is caused in the plastics material at the rotation of the rotor.

The metal core 13, 4, 5 is extruded from an aluminium alloy and cut to the right length, then the ends are turned down to form the shaft ends 3. After that the rotor body is moulded on the metal core 13, 4, 5 and axially somewhat in excess of the core, such that only the turned down shaft ends 3 of the metal core are visible.

It is, as mentioned before, essential that the wings 5 are placed in the central parts of the lands 10 in order to as much as possible reduce the tensile stresses in the plastics material along the surface of the metal core 13, 4, 5.

In the embodiment shown in FIG. 5 an increased bending strength has been achieved by the metal core 13, 4, 5 being extruded in the shape of a hollow body. A circular cylindrical hole 15 of the care part 13 has a number of inwardly directed, straight lands or splines 16 therein. A steel shaft 17 provided with a number of grooves 18 corresponding to the lands or splines 16 is pressed inside of circular cylindrical hole 15.

What is claimed as new is:

1. A rotor for a screw rotor machine, the rotor having a number of helically extending lands (10) and intermediate grooves forming a working face of the rotor, the rotor comprising:

a shaft member (13);

a rotor body (1) made of plastics material molded on the shaft member (13) so as to adhere to the surface of the shaft member (13), said rotor body made of plastics material defining said lands such that said lands are substantially made of plastics material; and a plurality of radially directed projections (4) extending from the shaft member (13) with substantially equal distribution around the shaft member (13);

said projections (4) being integrally formed as one piece with the shaft member (13) and extending helically around the surface of the shaft member (13) with the same pitch as the lands (10), said projections (4) each being associated with and in registration with a respective corresponding land (10), and said projections also extending into a central part of the corresponding land (10); and said projections (4) further having substantially peripherally directed wings (5) with smoothly rounded edges, said wings (5) being integrally formed as one piece with said projections (4), said wings (5) being located substantially in the central part of the corresponding land (10) and being dimensioned to relieve during rotation of the rotor a large part of tensile stresses acting on the plastics material of said rotor body (1) adhering to the surface of the shaft member (13).

2. The rotor of claim 1, wherein each of said radially directed projections (4) has two oppositely directed peripherally extending wings (5) originating from an end portion thereof.

3. The rotor of claim 1, wherein said radially directed projections (4) and said wings (5) extend with substantially no disruption along the length of the rotor between respective ends of the rotor.

4. The rotor of claim 1, wherein said shaft member (13), said projections (4) and said wings (5) comprise a single extrusion of metal material.

5. The rotor of claim 4, wherein said metal material comprises a light metal alloy.

6. The rotor of claim 1, wherein said shaft member (13) which is integrally formed as one piece with said projections (4) is made of metal.

7. The rotor of claim 6, wherein said projections (4) and wings (5) are integrally formed as one metal piece with said metal shaft member (13).

8. The rotor of claim 1, wherein said shaft member (13) is a hollow metal shaft member, and further comprising a metal shaft (17) extending through the hollow portion of said hollow shaft member.

9. The rotor of claim 8, further comprising anti-rotation means (16, 18) for preventing rotation between said shaft (17) and said hollow shaft member (13).

10. The rotor of claim 8, wherein said hollow shaft member (13), said projections (4) and said wings (5) comprise a single extrusion of metal material.

11. The rotor of claim 10, wherein said metal material comprises a light metal alloy.

12. The rotor of claim 8, wherein said hollow shaft member (13) which is integrally formed as one piece with said projections (4) is made of metal.

* * * * *

UNITED STATES PATENT AND TRADEMARK OFFICE

CERTIFICATE OF CORRECTION

PATENT NO. : 5,165,881

DATED : November 24, 1992

INVENTOR(S) : Jan WICEN

It is certified that error appears in the above-identified patent and that said Letters Patent is hereby corrected as shown below:

Column 3:

Line 13, change "care" to --core--.

Signed and Sealed this

Third Day of May, 1994

*Attest:*

*Attesting Officer*

BRUCE LEHMAN

*Commissioner of Patents and Trademarks*